United States Patent [19]

Schwartz et al.

[11] Patent Number: 4,794,576

[45] Date of Patent: Dec. 27, 1988

[54] COMBINATION ELECTRICAL CONTACT MEMBER AND BRAKING MEMBER FOR A TIMEPIECE

[75] Inventors: Herbert Schwartz, Wurmberg; Friedrich Mose, Pforzheim-Wurm; Adolf Sedlak, Wurmberg/Neubarental, all of Fed. Rep. of Germany

[73] Assignee: Timex Corporation, Middlebury, Conn.

[21] Appl. No.: 149,798

[22] Filed: Jan. 29, 1988

[51] Int. Cl.[4] ..... G04B 17/12; G04B 27/02

[52] U.S. Cl. ..... 368/185; 368/190; 368/204; 368/321

[58] Field of Search ..... 368/76, 80, 74, 185–190, 368/203–204, 319–321

[56] References Cited

U.S. PATENT DOCUMENTS

| | | | |
|---|---|---|---|
| 3,487,633 | 1/1970 | Wuthrich | 368/185 |
| 3,765,164 | 10/1973 | Esselborn | 368/190 |
| 4,074,093 | 2/1978 | Ikehata et al. | 368/187 |
| 4,241,439 | 12/1980 | Skuarek | 368/204 |
| 4,295,215 | 10/1981 | Kitai et al. | 368/190 |
| 4,408,896 | 10/1983 | Kegami | 368/185 |
| 4,496,246 | 1/1985 | Ota et al. | 368/220 |

*Primary Examiner*—Vit W. Miska

*Attorney, Agent, or Firm*—William C. Crutcher

[57] ABSTRACT

An improved contact spring in a movement for a timepiece having a frame, a stepping motor, an energy cell, a circuit driving the stepping motor with a switching terminal for disabling the stepping motor, a gear train driven by the stepping motor, and a manually actuatable stem disposed in the frame. The improved contact spring comprises a shaped member of electrically conductive spring metal with a battery contact portion and a circuit supply portion respectively engaging the energy cell and the supply terminal of the circuit. The contact spring has a spring biased first arm actuated by movement of the stem, said first arm having a braking portion adapted to supply a braking force to a member of the gear train when the stem is actuated. The arm may further include a switching portion adapted to make and break contact with the switching terminal of the circuit to disable the stepping motor when the stem is actuated. The improved contact spring may further include a spring-biased second arm adapted to provide detenting of the stem.

4 Claims, 4 Drawing Sheets

COMBINATION ELECTRICAL CONTACT MEMBER AND BRAKING MEMBER FOR A TIMEPIECE

BACKGROUND OF THE INVENTION

This invention relates generally to electronic quartz analog timepieces with hour, minute, and seconds hands having a stepping motor driving the hands through a gear train, having an energy cell with electronic circuit operating the stepping motor and a stem which is manually movable to set the timepiece hands. More particularly, the invention relates to an improved multiple function contact spring used in such a timepiece movement.

Quartz analog watches occasionally require manual setting of the hands. This is usually accomplished by pulling out a crown attached to a stem causing a gear on the stem to be engaged, and rotating the crown to change the hand setting. In a three-hand watch, it is desirable for the seconds hand to spin or move while the hour hand and minute hand are being set. In an electric or electronic watch, which would otherwise permit this to happen, usually there is a mechanical brake for the "seconds" wheel and a friction clutch permitting the gears carrying the hours hand and minutes hand to rotate while the seconds wheel is held stationary. Such a friction device permitting slippage during hand setting in a mechanical movement is seen in U.S. Pat. No. 3,487,633 issued Jan. 6, 1970 to P. Wuthrich.

Electric or electronic watches further have a requirement that an electrical connection be made between the energy cell and the watch circuit, in order to supply energy to the watch motor. Such watches also have had a provision to disconnect the source of electric driving pulses to the stepping motor when the watch crown is withdrawn by actuating switching contacts which disable the motor. With this arrangement, the timepiece may be shipped or stored with the energy cell effectively disconnected, preventing current drain and ensuring a fresh energy cell when the timepiece is initially activated.

It is also well-known in timepieces to provide a spring biased arm or detent spring acting in conjunction with two or more spaced detent grooves on the stem to hold it in one or more selected positions when it is manually actuated by means of the watch crown. All of the above described features of quartz analog timepieces are well-known in the art as separate features.

In an effort to reduce the cost of electronic quartz analog timepiece movements, members of intricate shape have been devised which perform several functions. For example, in the following U.S. patents assigned to applicant's assignee, special shaped members perform more than one necessary function. In U.S. Pat. No. 3,765,164 issued Oct. 16, 1973 to Fred Esselborn,a spring member is disclosed which also acts as a braking member for a balance wheel when the stem is actuated. In U.S. Pat. No. 4,241,439 issued Dec. 23, 1980 to Skwarek, an electrically conductive spring contact member performs an electrical connection between the energy cell and the circuit, while also physically holding the circuit board in the watch frame. In U.S. Pat. No. (Ser. No. 033,933 filed Apr. 3, 1987 to Wuthrich), a spring contact member acts as a detent for the watch stem, makes contact between the energy cell and the circuit board, and performs a switching functionto disconnect the motor when the stem is actuated.

It would be desirable to devise yet additional multiple functions to be performed by a single spring contact member in a quartz analog timepiece which are necessary to the operation of the timepiece.

Accordingly, one object of the present invention is to provide an improved contact spring which performs functions such as an electrical connection between the energy cell and the watch circuit, braking of the seconds wheel when the stem is actuated, disconnecting the electrical circuit from the motor when the stem is actuated, and detenting the stem.

Another object of the invention is to reduce the cost of a quartz analog timepiece by improvements in a spring contact member which performs multiple functions in the timepiece.

SUMMARY OF THE INVENTION

Briefly stated, the invention comprises an improved contact spring in a movement for a timepiece having a frame, a stepping motor, an energy cell, a circuit driving the stepping motor with a switching terminal for disabling the stepping motor, a gear train driven by the stepping motor, and a manually actuatable stem disposed in the frame. The improved contact spring comprises a shaped member of electrically conductive spring metal with a battery contact portion and a circuit supply portion respectively engaging the energy cell and the supply terminal of the circuit, the contact spring having a spring biased first arm actuated by movement of the stem, said first arm having a braking portion adapted to supply a braking force to a member of the gear train when the stem is actuated. The first arm may further include a switching portion adapted to make and break contact with the switching terminal of the circuit to disable the stepping motor when the stem is actuated. The improved contact spring may further include a spring-biased second arm adapted to provide detenting of the stem.

DRAWINGS

The invention, both as to organization and method of practice, together with further objects and advantages thereof, will best be understood by reference to the following description taken in connection with the accompanying drawings, in which:

FIG. 1 is a back plan view of a quartz analog wristwatch movement according to one form of the present invention, FIG. 2 is a bottom plan view of the improved contact spring used in the movement of FIG. 1, FIG. 3 is an elevation drawing in cross-section taken along lines III—III of FIG. 1, FIG. 4 is an elevation drawing in cross-section taken along lines IV—IV of FIG. 1, FIG. 5 is an elevation drawing in cross-section taken along lines V—V of FIG. 1, FIG. 6 is an elevation drawing in cross-section taken along lines VI—VI of FIG. 1, and FIG. 7 is an elevation drawing in cross-section taken along the lines VII—VII of FIG. 1.

DESCRIPTION OF THE PREFERRED EMBODIMENT

Figure 1:
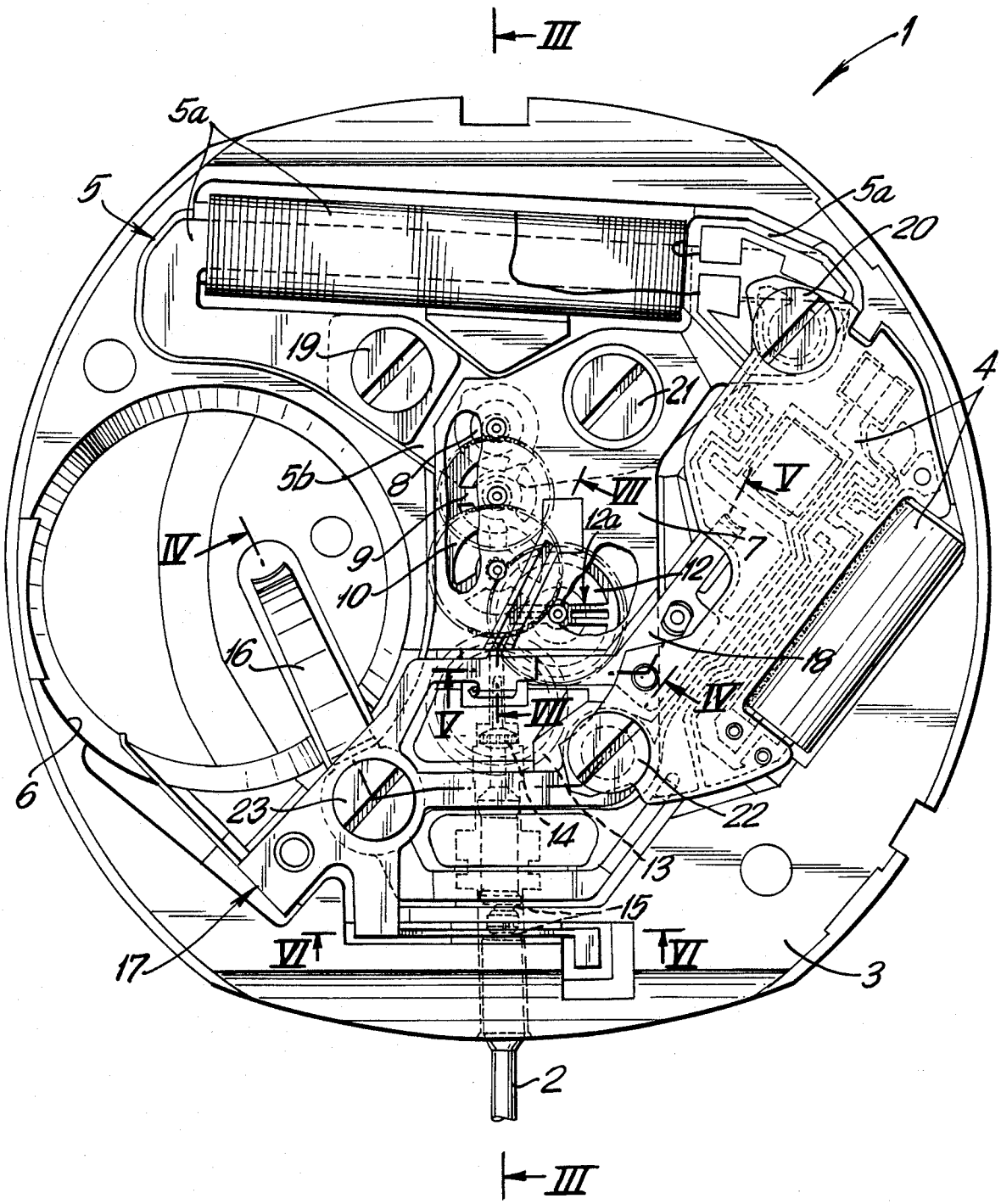

Referring now to FIG. 1 of the drawing, FIG. 1 is a bottom plan view of a wristwatch movement, shown generally as 1, with the energy cell removed. Movement 1 would normally be disposed in a wristwatch case and fitted with hands and dial (none of which are shown). The wristwatch hands are set with a manually actuable stem 2 which extends through the watch case and is fitted with a crown (not shown), so that stem 2 may be moved longitudinally, as well as rotated to set the hands of the timepiece as is generally understood. The timepiece movement 1 comprises a frame 3 of plastic material designed to contain and support the other elements of the movement. Broadly these include a circuit 4, which is an assembly of a quartz crystal and a printed circuit board with an integrated circuit and electrical contact terminals on its underside. Output from the integrated circuit is connected to provide periodical pulses to drive a stepping motor 5, having a coil and core assembly 5*a* and a stator 5*b*. An energy cell for supplying power to the circuit comprises a button cell (not shown) disposed in a circular recess 6 in frame 3. A bridge 7 is attached to and spaced from a part of frame 3, so as to support the rotatable members of the movement. Such rotatable members include a stepping motor rotor assembly 8, and wheel assemblies 9 and 10. Stepping motor rotor assembly 8 has a permanent magnet designed to rotate within a stator 5*b*. Rotor assembly 8 has a pinion which drives an intermediate wheel assembly 9, which in turn drives a "seconds" wheel assembly 10. The "seconds" wheel assembly 10 includes a spindle 11 (see FIG. 3) to which the "seconds" hand is attached.

The "seconds" wheel assembly has a pinion which drives a third wheel assembly 12 through a friction drive or slip clutch arrangement indicated at 12*a*. The third wheel assembly 12 includes an output pinion cooperating with additional gear train members (not shown) which ultimately operate the "minutes" and "hours" hands. A setting gear 13 with teeth parallel to the gear axis (see also FIG. 3) is part of the hours and minutes hands gear train and is engagable with a stem gear 14 on stem 2 when the stem is withdrawn from a first "disengaged" position as shown in the drawing to a second "engaged" (or setting) position. When stem 2 is in the setting position with gears 13, 14 engaged, the friction drive or clutch assembly 12*a* would normally permit the continued rotation of rotor 8 and wheel assemblies 9, 10 in a manner known in the art by allowing the slipage of third wheel assembly 12 on its shaft. Stem 2 is retained either in the first position or in the hand setting second position by a pair of spaced detent grooves 15 cooperating with a spring biased arm which will be explained in detail later in connection with the subject invention.

In order to make electrical connections between the energy cell and the watch circuit, a spring clip 16 is provided, which makes contact on one end with the negative terminal of the battery (see also FIG. 4) and at the other end on the underside of the circuit board 4. The other electrical connection between the energy cell and the watch circuit is through a contact spring 17 which is the subject of the present invention. Part of contact spring 17 makes permanent electrical connection between the positive terminal on the side of the energy cell and another part of contact spring 17 is permanently in contact with a supply terminal 4*a* on the underside of the circuit board 4 (see also FIG. 4), this being termed a "first electrical connection means."

The stepping motor watch circuit 4 is also provided with a switching terminal 4*b* on the underside of the circuit board 4 which, when connected to the positive terminal of the energy cell will disable and inactivate the stepping motor. In order that the switching terminal can be extended to the neighborhood of the contact spring 17, an electrical bridge member 18 is provided (see also FIG. 5).

The aforementioned components are held in the movement frame 3 by a number of threaded screws designated at 19, 20, 21, 22, and 23. These screws serve to hold the elements of stepping motor 5, bridge 7, circuit board 4, battery spring clip 16, and the spring contact member 17 in place, these components being assembled from the backside of the movement.

Figure 2:
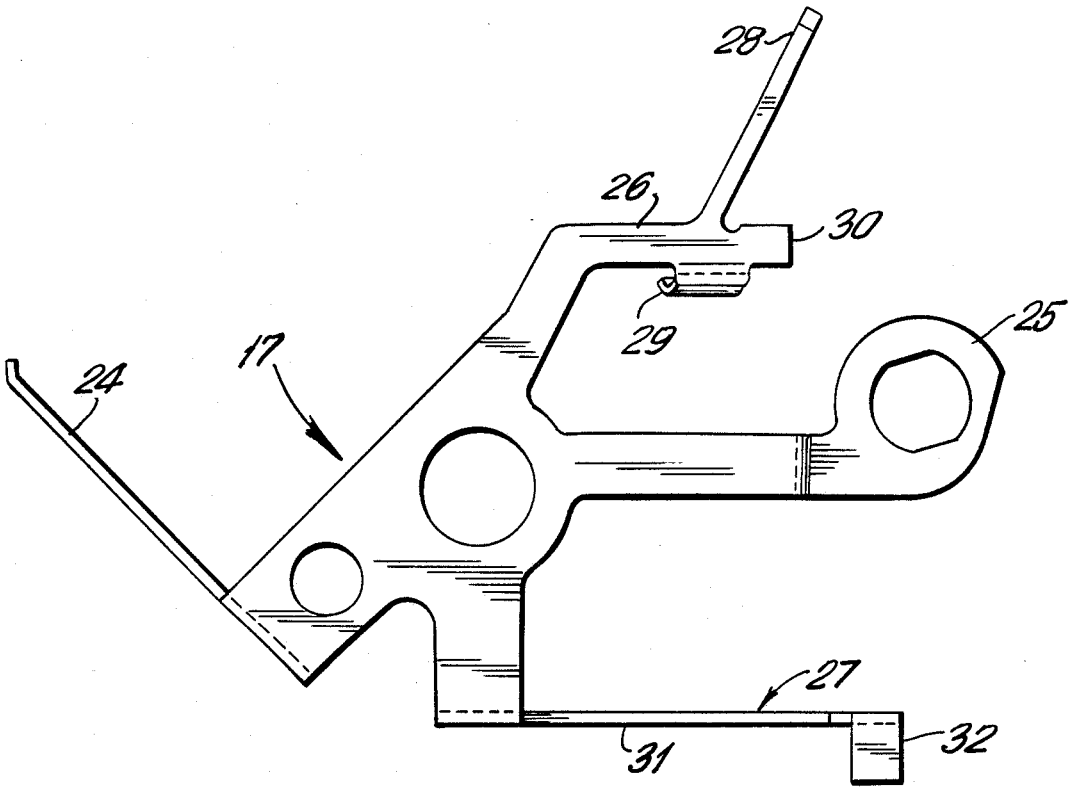

Referring now to FIG. 2 of the drawing, the spring contact member 17 is shown to comprise a shaped member of electrically conductive spring metal with various extensions which are arranged to perform several functions and are designed in accordance with the particular constraints and dimensions of the watch movement. Contact spring 17 includes a battery contact portion 24, a circuit supply portion 25, a spring biased first arm 26 and a spring biased second arm 27. The spring biased first arm itself includes several functional portions, these being a braking finger portion 28 an actuating portion 29, and a switching portion 30.

The spring biased second arm 27 includes thereon a detenting portion 31 and a stem removal tab 32.

Figure 3:
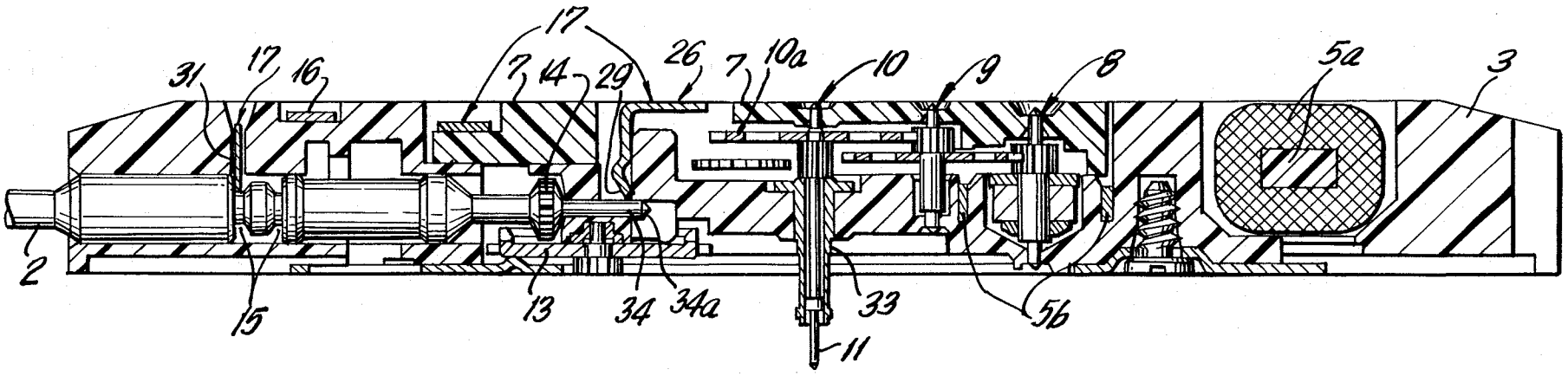

Reference now to the various cross-sectional drawings will illustrate the invention in better detail. FIG. 3 which is a cross-section taken along the axis of the stem 2, shows the elements of the stepping motor coil and core assembly 5*a*, the stator portion 5*b*, and the stepping motor rotor assembly 8. Rotor assembly 8 drives intermediate assembly 9, which drives "seconds" wheel assembly 10. A fixed centerpost 33 in the movement frame 3 rotatably journals the "seconds" spindle 11 on the dial side of the watch. Other gear train elements are omitted in order not to obscure the drawing, but would include a gear train driven from a pinion on seconds wheel assembly 10, and operating "hour" hand and "minute" hand sleeves mounted on center post 33.

The manually actuatable watch stem 2 terminates in a stem end portion 34 with a pointed tip 34*a*. The contact spring 17, corss-sections of which are identified by multiple lead lines, shows the actuating portion 29 resting on the stem end 34 when the stem is in a first position. The detent portion 31 of contact spring 17 is seen resting in one of the spaced detent grooves 15 which retains the stem in the first position. A part of the spring biased first arm 26 is shown to be in close proximity with a "seconds" wheel 10*a* of the seconds wheel assembly 10.

Figure 4:
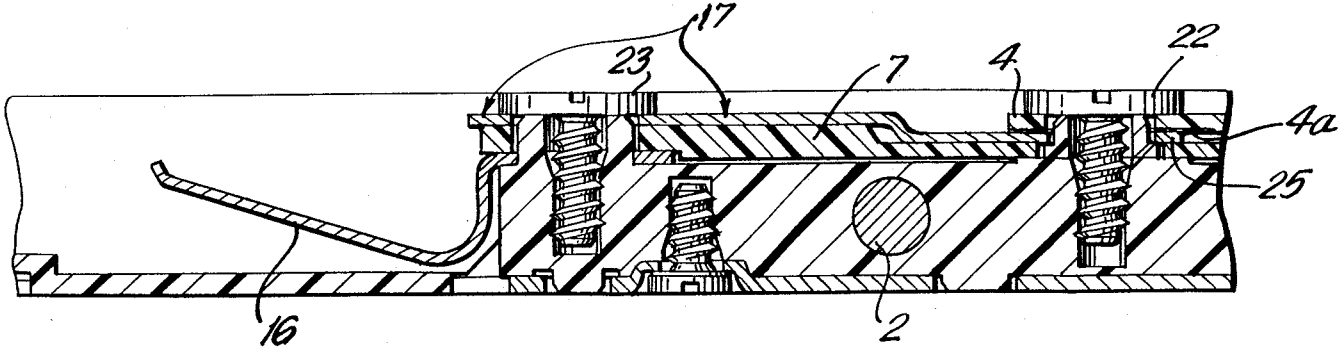

FIG. 4 of the drawing, which is a section taken along lines IV—IV illustrates the permanent electrical connections from the energy cell to the battery. The negative battery contact spring 16 and spring contact 17 are clamped in place to the frame by threaded screw 23 and electrically insulated from one another by a portion of bridge 7. The circuit supply portion 25 of spring contact 17 extends beneath the circuit board 4 where it makes electrical connection with a supply terminal 4*a* and is rigidly connected thereto by means of threaded screw 22.

Figure 5:
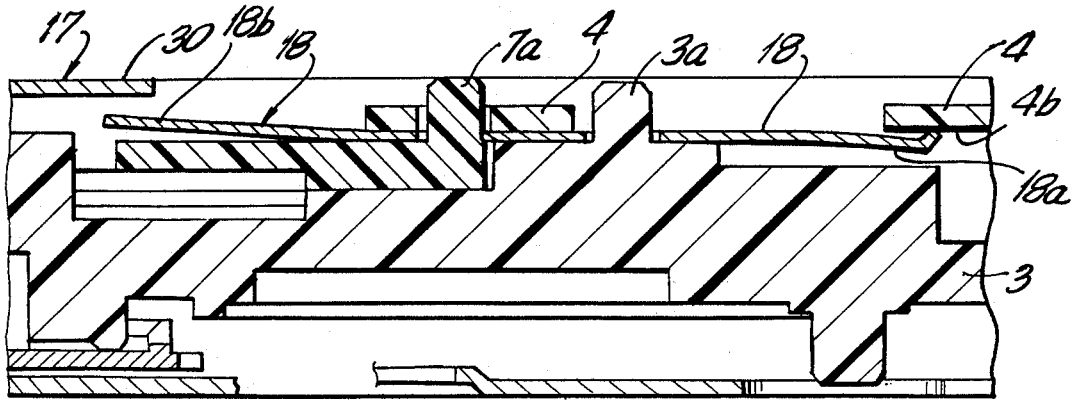

Referring to FIG. 5 of the drawing, the frame 3 and bridge 7 are seen to include integral pins 3*a*, 7*a* which support and locate the electrical bridge 18. One end 18*a* of the electrical bridge 18 contacts a switching terminal 4*b* on the underside of the circuit board for disabling the stepping motor and the other end 18*b* is in close proximity to the switching portion 30 of spring contact 17.

Figure 6:
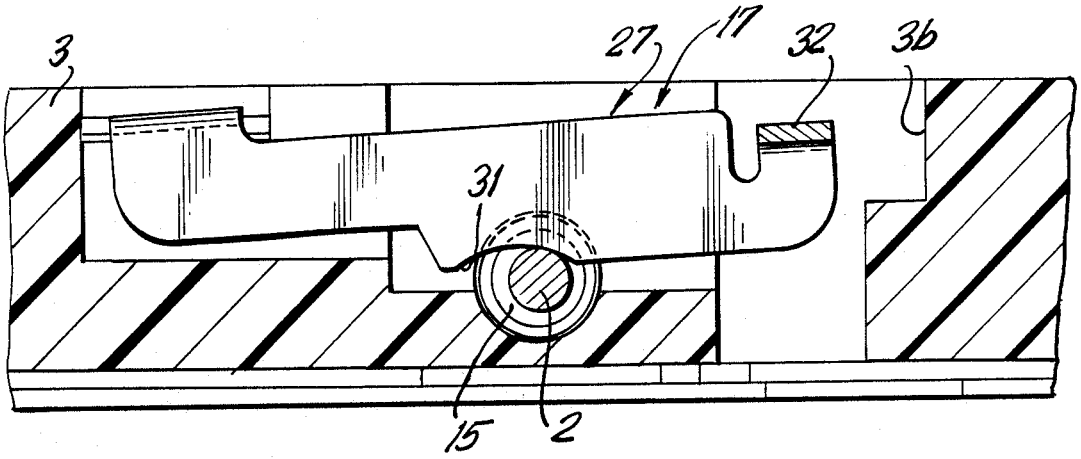

Referring now to FIG. 6 of the drawing, the spring biased second arm 27 of spring contact 17 is shown with its detent portion 31 resting in one of the spaced detent grooves 15. The stem removal tab 32 is located in a frame recess 3*b*. This permits inertion of an instrument beneath tab 32 to lift spring biased arm 27 so that the stem can be removed from the movement.

Figure 7:
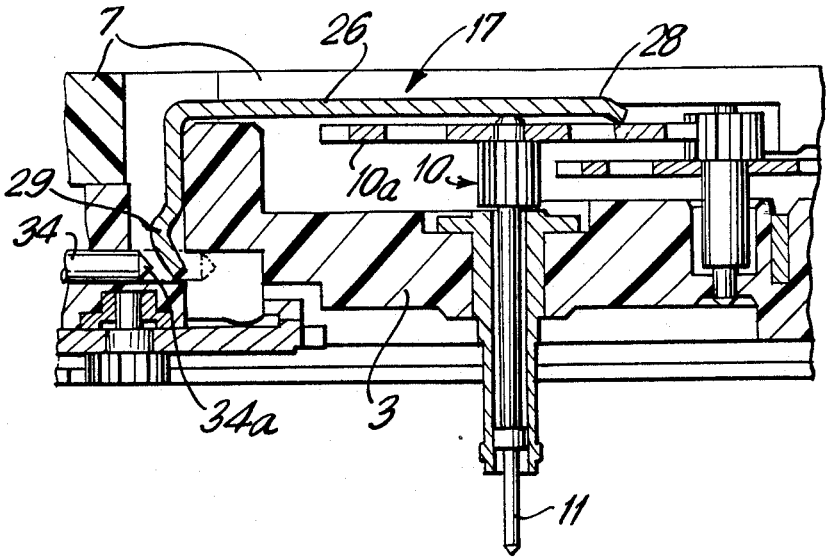

Reference now to FIG. 7 of the drawing shows a cross-section through portions of the spring biased first arm, taken along lines VII—VII of FIG. 1. However, in FIG. 7, the actuating stem has been withdrawn into its second position with the stem end 34 retracted, so as to allow the actuating portion 29 of spring contact member 17 to drop to a lower position in the frame. This is because of the spring bias provided by the first arm 26. When the stem is retracted, and when spring contact first arm 26 is in this position, the braking portion 28 touches the "seconds" wheel 10*a* to prevent rotation of the "seconds" wheel assembly 10. In this manner, the rotatable member 10 is prevented from rotation along with its connected gear train rotatable members 8 and 9. However, the other gear train elements such as wheels 12, 13 are permitted to rotate when the stem is rotated due to the slip clutch 12*a*.

When the spring biased first arm 26 drops to the position indicated in FIG. 7 the second electrical connections means also functions to disable the stepping motor as seen in FIG. 5. The switching portion 30 of the contact spring will drop to make contact with the electrical bridge 18, so as to disable the stepping motor.

The spring biased second arm 27 of contact spring 17 with detenting portion 31 performs a detenting function to hold the stem in the second position while setting of the hour hands and minute hands proceeds.

Therefore, the improved contact spring of the invention performs many functions, which may include the following:

1. A first permanent electrical connection is made between a battery contact portion 24 and a circuit supply portion 25.

2. A braking force is supplied by the braking finger portion 28 when the stem is withdrawn.

3. An intermittent switching function is performed by the switching portion 30 making contact with a switching terminal to disable the stepping motor, and 4. A spring biased second arm performs a detenting function to hold the stem in first or second positions.

While there has been described what is considered to be the preferred embodiment of the invention, other modifications will occur to those skilled in the art. For example, the spring biased second arm detenting may be eliminated in some cases. The spring contact member may take various other configurations from that shown, so as to fit the particular watch movement. Other modifications will occur to those skilled in the art and it is desired to secure in the appended claims all such modifications as fall within the true spirit and scope of the invention.

We claim:

1. In a movement for a timepiece having a frame, a stepping motor, an energy cell, a circuit adapted to periodically advance said stepping motor when connected to said energy cell and including first electrical connection means having a supply terminal and second electrical connection means having a switching terminal for disabling said stepping motor, a gear train connected to be driven by said stepping motor, said gear train having at least one rotatable member, and a manually actuatable stem disposed in said frame and movable between a first position and a second position, said stem defining at least two spaced detent grooves, the improvement comprising:

a contact spring comprising a shaped member of electrically conductive spring metal having a battery contact portion and a circuit supply portion respectively connected to said energy cell and said supply terminal of said first electrical connection means, said contact spring having a spring-biased first arm actuated by movement of said stem, said first arm having a braking finger portion adapted to apply a braking force to said rotatable member when the stem is actuated.

2. The improvement according to claim 1, where said spring biased first arm further includes a switching portion adapted to make and break contact with the switching terminal of said second electrical connection means to disable said stepping motor, when the stem is actuated.

3. The improvement according to claim 2 wherein said first spring biased arm includes an actuating portion adapted to cooperate with said stem and arranged to actuate said first arm when said stem is moved from said first position to said second position.

4. The improvement according to claims 1 or 2 or 3, wherein said contact spring further includes a spring biased second arm having a detent portion adapted to cooperate with said spaced detent grooves of said stem to retain it in said first or second position.

* * * * *